United States Patent [19]

Parnell

[11] Patent Number: 4,896,912

[45] Date of Patent: Jan. 30, 1990

[54] SANITARY METHOD AND APPARATUS FOR WASTE COLLECTION AND DISPOSAL

[76] Inventor: Vernon A. Parnell, 5208 W. North Ave., Chicago, Ill. 60639

[21] Appl. No.: 252,597

[22] Filed: Oct. 3, 1988

[51] Int. Cl.[4] ..... A01K 29/00

[52] U.S. Cl. ..... 294/1.3; 15/257.1

[58] Field of Search ..... 294/1.4, 1.3, 1.5, 1.1, 294/19.1, 55, 57; 15/257.1, 257.2, 257.4, 257.7, 104.8; 248/95, 99, 101

[56] References Cited

U.S. PATENT DOCUMENTS

| | | | |
|---|---|---|---|
| 783,657 | 2/1905 | Walter | 15/257.2 |
| 3,778,097 | 12/1973 | Dorzon | 294/1.4 |
| 3,937,509 | 2/1976 | Hufnagel . | |
| 3,942,831 | 3/1976 | Sosnove | 294/1.4 |
| 4,047,746 | 9/1977 | Radowski . | |
| 4,058,337 | 11/1977 | Isac | 294/1.4 |
| 4,165,895 | 8/1979 | Bacoka . | |
| 4,196,928 | 4/1980 | Spangler . | |
| 4,222,597 | 9/1980 | Willis | 294/1.4 |
| 4,243,259 | 1/1981 | Wright | 294/1.3 |
| 4,349,224 | 9/1982 | Shiozaki . | |
| 4,447,082 | 5/1984 | Lindholm . | |
| 4,705,310 | 11/1987 | Scripter . | |
| 4,741,565 | 5/1988 | Bagg . | |

FOREIGN PATENT DOCUMENTS 3325696 1/1985 Fed. Rep. of Germany ..... 294/1.4

*Primary Examiner*—Margaret A. Focarino
*Assistant Examiner*—Dean J. Kramer
*Attorney, Agent, or Firm*—Emrich & Dithmar

[57] ABSTRACT

A waste material collection and disposal apparatus includes a long-handled scoop and a long-handled scraper releasably coupled together with a carrying ring, and a supply of first and second flexible disposable bags, which may also be carried by means of a clip on the carrying ring. In use, a receptacle portion of the scoop and a blade portion of the scraper are respectively enclosed within first and second bags, which are then secured in a closed condition about the handles of the scoop and scraper with twister ties. The scraper is released from the carrying ring and used to scrape the waste material into the receptacle. Then the bags are untied and inverted for removing them for the scoop receptacle and scraper blade, respectively, and simultaneously enclosing therein collected waste material. The bags are then secured closed with the twister ties for disposal.

2 Claims, 1 Drawing Sheet

10
15
20
21
22
23
24
25
27
30
31
32
33
34
35
36
40
41
42
45
46
47
50
55
57

SANITARY METHOD AND APPARATUS FOR WASTE COLLECTION AND DISPOSAL

BACKGROUND OF THE INVENTION

1. The Field of the Invention

The present invention relates to apparatus and techniques for collecting waste materials, particularly animal litter, such as dog feces or the like.

2. Description of the Prior Art

It is known in the prior art to provide utensils for collecting and disposing of waste material, such as pet's excrement, this being a particular problem in urban areas. Such prior art devices have included scoop or shovel-type devices, usable either alone or in combination with an associated scraper or pusher tool to scoop up the waste material.

It is also known to provide disposable receptacles, such as bags, or the like, with such collection devices for facilitating disposal of the waste material. In some of these devices the bag is simply an attachment to a open-bottom scoop, as in U.S. Pat. No. 4,447,082. But in this type of device the waste material comes in contact with the scoop, creating sanitation problems. In yet another type of device, disclosed in U.S. Pat. No. 4,741,565, the shovel or scoop has a bag or cover draped over the handle and the user's hand and, after the waste material is scooped up the sleeve is draped back over the scoop and closed around the scoop and the waste material collected thereon. Then the entire apparatus is discarded.

Other prior devices have avoided the contamination problem by providing only a frame which supports the bag, the bag providing the receptacle and covering the frame so as to prevent contact of the waste material therewith, as in U.S. Pat. Nos. 4,705,310 and 4,047,746. It is also known to use the bag as a liner for a scoop or shovel device to prevent contact of the waste material therewith, as in U.S. Pat. No. 3,937,509. But these devices do not provide very effective scoops when used by themselves, and they do not provide an associated scraping or pushing tool.

Two-piece devices utilizing both a receptacle part and a scraper or pusher part are disclosed, for example, in U.S. Pat. Nos. 4,349,224, 4,196,928 and 4,165,895. But in these devices the disposable bag only covers a receptacle frame. The associated scraper or pusher tool is not protected and comes in contact with the waste material.

SUMMARY OF THE INVENTION

It is a general object of the present invention to provide an improved waste collection and disposal apparatus and method which avoid the disadvantages of prior apparatuses and methods, while affording additional structural and operating advantages.

An important feature of the present invention is the provision of an apparatus which provides for completely sanitary operation.

In connection with the foregoing feature, it is another feature of the invention to provide an apparatus of the type set forth which effectively prevents waste material from coming in contact with the user's hands.

In connection with the foregoing features, it is still another feature of the invention to provide an apparatus of the type set forth, which includes tools which are protected from contact with the waste material.

Another feature of the invention is the provision of apparatus of the type set forth which affords simple and sanitary disposal of the waste material.

Yet another feature of the invention is the provision of an apparatus of the type set forth, which is characterized by simple and economical construction and ease of use.

Another feature of the invention is the provision and method of operation of apparatus of the type set forth.

Certain of these features of the invention are attained by providing apparatus for sanitary collection and disposal of waste material comprising: a scoop having a receptacle portion and an elongate handle portion, a scraper having a blade portion and an elongate handle portion, first flexible disposable bag means adapted to be fitted over the receptacle portion of said scoop for enclosing the receptacle portion in a covering configuration, second flexible disposable bag means adapted to be fitted over the blade portion of the scraper for enclosing the blade portion in a covering configuration, and means for releasably securing the first and second bag means in the covering configurations thereof respectively to the scoop and the scraper.

Still others of these features of the invention are achieved by providing a method for sanitary collection and disposal of waste material by use of a receptacle and a scraper blade comprising the steps of: covering the receptacle by enclosing it within a first flexible disposable bag, releasably securing the first bag in place about the receptacle, covering the scraper blade by enclosing it within a second flexible disposable bag, releasably securing the second bag in place about the scraper blade, scraping the waste material into the covered receptacle with the covered scraper blade, inverting the first bag so as to remove it from about the receptacle and simultaneously enclose the collected waste material therein, and inverting the second bag so as to remove it from about the scraper blade and simultaneously enclose in the second bag any waste material residue thereon.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 2, 3, 4, 5, 6, 7, 8:
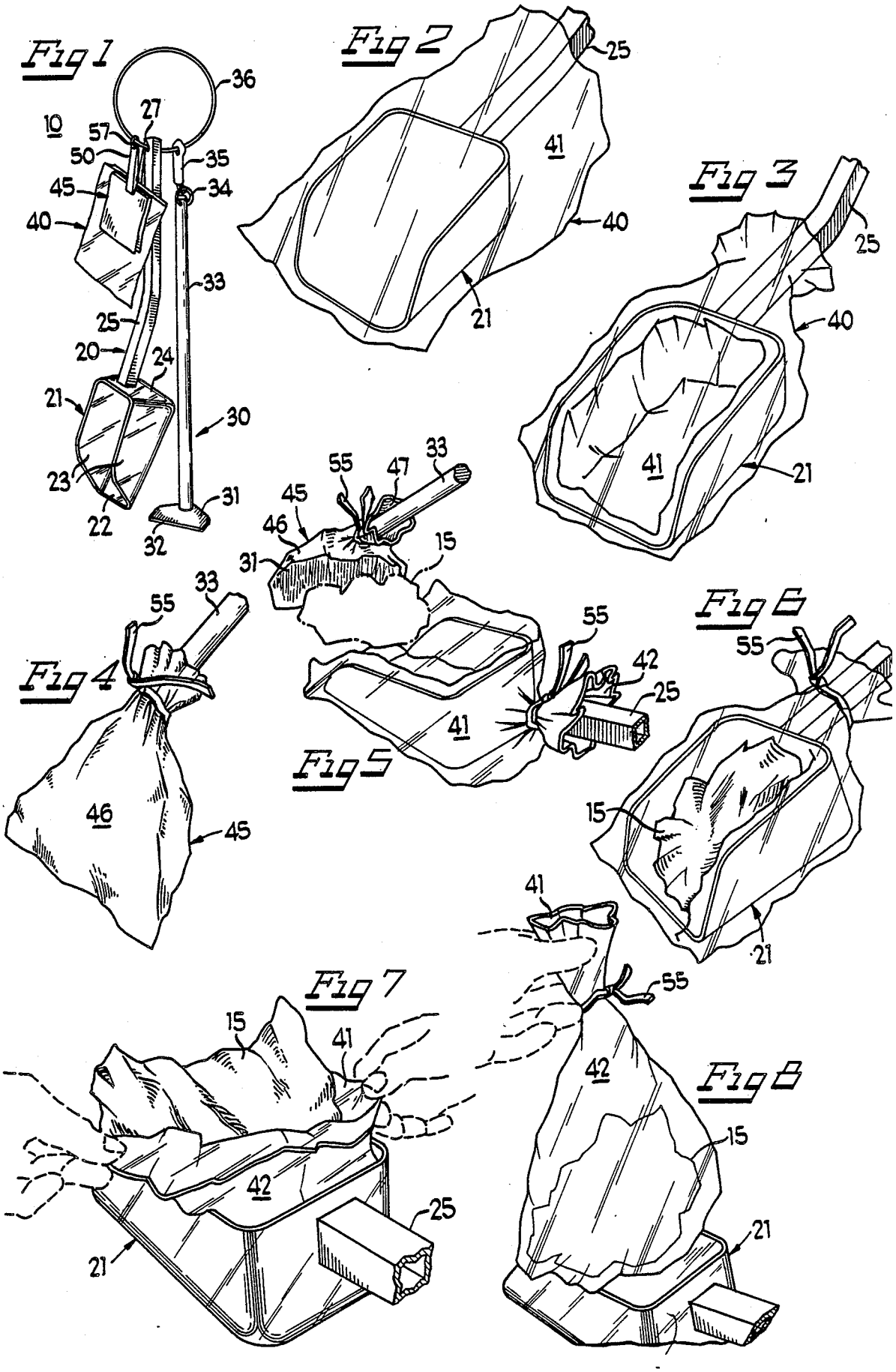
FIG. 1 is a perspective view of waste collection and disposal apparatus, constructed in accordance with and embodying the features of the present invention.
FIG. 2 is an enlarged, fragmentary, perspective view of the receptacle portion of the scoop of the apparatus of FIG. 1, illustrating the covering thereof with an associated bag.
FIG. 3 is a view similar to FIG. 2, illustrating the conforming of the bag to the shape of the scoop receptacle.
FIG. 4 is an enlarged, fragmentary, perspective view illustrating the blade end of the scraper of the apparatus of FIG. 1 covered with an associated bag.
FIG. 5 is an enlarged, fragmentary, perspective view illustrating use of the apparatus of FIG. 1 in collecting waste material.
FIG. 6 is a view similar to FIG. 3 illustrating collected waste material in the scoop receptacle.
FIG. 7 is a still further enlarged, fragmentary, perspective view illustrating removal of the bag from the scoop receptacle to enclose the collected waste material.
FIG. 8 is a reduced view similar to FIG. 7 and illustrating the waste material enclosed in the collecting bag.

Referring to FIG. 1, the present invention includes a collection apparatus, generally designated by the numeral 10, for the collection and disposal of waste material 15 (see FIG. 5), such as pet excrement and the like. The collection apparatus 10 includes a scoop 20 which has a generally box-shaped receptacle 21. The receptacle 21 includes a flat rectangular bottom wall 22, integral at the opposite sides thereof with upstanding side walls 23 and a rear wall 24, the front and top of the receptacle 21 being open. Integral with the rear wall 24 and projecting therefrom is an elongated handle 25 which is provided at the distal end thereof with a hole 27 therethrough.

The apparatus 10 also includes a scraper 30 which has a flat, plate-like blade 31 with an elongated straight scraping edge 32. Integral with the front surface of the blade 31 at the upper end thereof and projecting therefrom substantially normal thereto is an elongated handle 33, which is provided at its distal end with a ring 34 to which is secured a clip 35.

The apparatus 10 also includes a carrying ring 36 which is disposed in use through the hole 27 in the scoop handle 25 for support thereof. Similarly, the clip 35 of the scraper 30 can be removably clipped to the carrying ring 36 for support thereby. In this manner, both the scoop 20 and the scraper 30 can be conveniently stored and carried together, when not in use.

The apparatus 10 also includes a plurality of large bags 40, which are open-top flexible receptacles which may be of any desired construction, but are intended to be inexpensive and disposable. In a preferred embodiment of the invention, the bags 40 are transparent plastic bags, but it will be appreciated that they could be opaque and could be formed of other materials. Each bag 40 has an outer surface 41 and an inner surface 42 (see FIGS. 2 and 5).

Similarly, the collection apparatus 10 includes a plurality of small bags 45, each of which has an outer surface 46 and an inner surface 47 (see FIGS. 4 and 5). The bags 45 also may be of any desired construction, but they are intended to be inexpensive and disposable. In a preferred embodiment of the invention, the bags 45 are opaque or translucent paper bags, but it will be appreciated that they could also be transparent and could be formed of other materials.

A plurality of the large bags 40 and small bags 45 may be carried on the carrying ring 36 by a bag clip 50, which may be a clothespin-type clip, provided at the distal end thereof with a hole 57 for receiving the ring 36 therethrough. The collection apparatus 10 also includes a plurality of common twister ties 55, each of which comprises a short length of thin wire encased in a paper sleeve, in a well-known manner.

Referring now to FIGS. 1 through 8 of the drawings, the operation of the collection apparatus 10 will be described. When the user walks his pet, he carries the collection apparatus 10, utilizing the carrying ring 36. A few of the twister ties 55 may be carried in the user's pocket. When the user wishes to collect waste material 15, the detaches one of the large bags 40 from the bag clip 50 and fits it over the receptacle 21 of the scoop 20, as illustrated in FIG. 2. The bag 40 is then pressed down into the receptacle 21 to conform generally to the shape thereof, as illustrated in FIG. 3, and the open end of the bag is then gathered tightly around the handle 25 and secured in place with one of the twister ties 55, as illustrated in FIG. 5.

Then, one of the small bags 45 is detached from the bag clip 50 and fitted over the blade 31 of the scraper 30, as illustrated in FIG. 4. The bag 45 may be conformed generally to the shape of the blade 31 and the open end of the bag 45 is then gathered tightly around the handle 33 of the scraper 30 and secured in place with one of the twister ties 55, as illustrated in FIGS. 4 and 5.

The scraper clip 35 is then detached from the carrying ring 36 and used to scrape the waste material 15 into the receptacle 21 of the scoop 20, as illustrated in FIG. 5. When all of the waste material 15 has been gathered into the receptacle 21, as illustrated in FIG. 6, the twister tie 55 is removed from the bag 40 to permit the bag 40 to be removed from the scoop 20. More particularly, the user grasps the open end of the bag 40 and inverts the bag, turning it inside out, thereby simultaneously removing the bag 40 from the scoop receptacle 21 and enclosing the waste material 15 inside the bag 40, as illustrated in FIGS. 7 and 8, so that the original outer surface 41 of the bag 40 which is in contact with the waste material 15 is now on the inside of the bag, and the original inner surface 42 is now on the outside. The open end of the bag 40 is then secured closed with the twister tie 55 for disposal.

In similar manner, the twister tie 55 is removed from the bag 45 on the scraper 30 and that bag also is inverted, thereby simultaneously removing it from the scraper blade 31 and disposing the original outer surface 46 of the bag 45 on the inside thereof, so that any residue of the waste material 15 on the bag 45 will now be confined inside the bag. The bag 45 is then closed and secured shut with a twister tie 55 for disposal. The scraper 30 is then clipped back onto the carrying ring 36.

In this manner it will be appreciated that there is provided a quick and sanitary collection and disposal of the waste material 15, so that it never comes in contact with either the hands of the user or with the scoop 20 or the scraper 30. Accordingly, the user does not have to be concerned with washing or otherwise cleaning the scoop 20 and scraper 30 after use. Also, the waste material 15 has been conveniently collected in the bags 40 and 45 for easy disposal.

I claim:

1. Apparatus for sanitary collection and disposal of waste material comprising: a scoop having a receptacle portion and an elongate handle portion, a scraper having a blade portion and an elongate handle portion, first flexible disposal bag means adapted to be fitted over said receptacle portion of said scoop for completely enclosing said receptacle portion in a covering configuration, second flexible disposal bag means adapted to be fitted over said blade portion of said scraper for completely enclosing said blade portion in a covering configuration, means for releasably securing said first and second bag means in the covering configuration thereof respectively to said scoop and said scraper, a coupling ring, and means securing said scoop and said scraper to said coupling ring so that at least one of said scoop and said scraper is releasable from said coupling ring, said coupling ring being received through a complementary opening in said handle portion of said scoop, said securing means including clip means carried by said handle portion of said scraper adapted to be releasably coupled to said coupling member.

2. Apparatus for sanitary collection and disposal of waste material comprising: a scoop having a receptacle portion and an elongate handle portion, a scraper having a blade portion and an elongate handle portion, first flexible disposable bag means adapted to be fitted over said receptacle portion of said scoop for completely enclosing said receptacle portion in a covering configuration, second flexible disposable bag means adapted to be fitted over said blade portion of said scraper for completely enclosing said blade portion in a covering configuration, means for releasably securing said first and second bag means in the covering configurations thereof respectively to said scoop and said scraper to said coupling ring so that at least one of said scoop and said scraper is releasable from said coupling ring, and means for releasably securing to said coupling ring a supply of said first and second bag means.

* * * * *

UNITED STATES PATENT AND TRADEMARK OFFICE

CERTIFICATE OF CORRECTION

PATENT NO. : 4,896,912

DATED : January 30, 1990

INVENTOR(S) : Vernon A. Parnell

It is certified that error appears in the above-identified patent and that said Letters Patent is hereby corrected as shown below:

Column 4, line 66, change "disposal" to --disposable--.

Column 5, line 1, change "disposal" to --disposable--;

line 5, change "configuration" to --configurations--.

Signed and Sealed this

Thirteenth Day of September, 1994

*Attest:*

*Attesting Officer*

Bruce Lehman

BRUCE LEHMAN

*Commissioner of Patents and Trademarks*